US011140966B2

(12) United States Patent
Thorpe

(10) Patent No.: US 11,140,966 B2
(45) Date of Patent: Oct. 12, 2021

(54) ROUNDED TIP APPLICATOR

(71) Applicant: HCT GROUP HOLDINGS LIMITED, Sheung Wan (CN)

(72) Inventor: Timothy Thorpe, Santa Monica, CA (US)

(73) Assignee: HCT GROUP HOLDINGS LIMITED, Hong Kong (CN)

( * ) Notice: Subject to any disclaimer, the term of this patent is extended or adjusted under 35 U.S.C. 154(b) by 17 days.

(21) Appl. No.: 16/687,101

(22) Filed: Nov. 18, 2019

(65) Prior Publication Data

US 2020/0154858 A1 May 21, 2020

Related U.S. Application Data

(60) Provisional application No. 62/769,379, filed on Nov. 19, 2018.

(51) Int. Cl.

| | |
|---|---|
| ***B43M 11/06*** | (2006.01) |
| ***A45D 40/26*** | (2006.01) |
| ***A45D 34/04*** | (2006.01) |

(52) U.S. Cl.

CPC ..... *A45D 40/261* (2013.01); *A45D 34/041* (2013.01); *A45D 2200/155* (2013.01)

(58) Field of Classification Search

CPC ..... A45D 34/041; A45D 40/261; A45D 2200/155

USPC ..... 401/183

See application file for complete search history.

(56) References Cited

U.S. PATENT DOCUMENTS

| | | | | |
|---|---|---|---|---|
| 7,883,287 | B2 * | 2/2011 | Thorpe | A45D 34/04 401/266 |
| 9,155,372 | B2 * | 10/2015 | Gieux | A45D 34/04 |
| 9,498,042 | B2 | 11/2016 | Villarreal et al. | |
| 9,681,728 | B2 * | 6/2017 | Jung | B65D 35/36 |
| 9,700,121 | B2 * | 7/2017 | Defert | A45D 40/261 |
| 9,848,684 | B2 * | 12/2017 | Kim | A45D 40/26 |
| 2010/0243677 | A1 * | 9/2010 | Lim | B05B 11/3015 222/256 |
| 2014/0234003 | A1 * | 8/2014 | Thorpe | A45D 29/16 401/1 |
| 2017/0295905 | A1 | 10/2017 | Kim et al. | |
| 2018/0177280 | A1 | 6/2018 | Maurin et al. | |

FOREIGN PATENT DOCUMENTS

| | | |
|---|---|---|
| CN | 105592747 B | 11/2018 |
| WO | 0103541 A1 | 1/2001 |

OTHER PUBLICATIONS

International Search Report and Written Opinion dated Mar. 10, 2020 for International Application No. PCT/US2019/062004.

* cited by examiner

*Primary Examiner* — Jennifer C Chiang

(74) *Attorney, Agent, or Firm* — Seager, Tufte & Wickhem LLP

(57) ABSTRACT

Cosmetics packaging and applicators are described. The cosmetic applicator includes a main body portion having a protrusion. The main body portion includes a product delivery passageway and an applicator having a rounded application surface coupled to the protrusion. The applicator has an opening for dispensing the product and is formed from a thermal storage material. The applicator may be a ball.

12 Claims, 5 Drawing Sheets

ROUNDED TIP APPLICATOR

CROSS REFERENCE TO RELATED APPLICATIONS

The present application claims the benefit of and priority to U.S. Provisional Patent Application Ser. No. 62/769,379, filed on Nov. 19, 2018 titled BALL TIP APPLICATOR, the disclosure of which is incorporated herein by reference.

BACKGROUND

Devices exist for dispensing cosmetic or medicinal products. Such devices usually have an outer tubular shell/housing, a delivery mechanism for displacement of the cosmetic or medicinal products, and an applicator tip. For example, in the medical industry, applicators are employed for applying medicinal products, such as ointments, to portions of the body. In the cosmetics and personal care industries, applicators are used to apply lipstick, lip balm, skin creams, lotions, and other cosmetic products to portions of the body.

In many cases, these medicinal and cosmetic products may include skin care substances, such as aloe or lanolin, that provide a healing or therapeutic effect to heal damaged skin or maintain healthy skin. In addition, these products may include therapeutic substances, such as topical anesthetics, analgesics, fragrances, menthol, or other substances that provide a soothing or stimulating sensation when applied to skin of a user of the product. In addition to skin care substances, thermal treatments (e.g., application of heat and/or cold) are known to relieve pain, provide a therapeutic sensation, and to slow the body's natural response to injury so that a slower and more controlled healing process may ensue.

Existing cosmetic and medicinal dispensers are limited to application of products to the skin, and do not provide for thermal treatments of the skin. Accordingly, there remains a need in the art for improved dispensers.

SUMMARY

The present inventors have recognized, among other things, that a problem to be solved is a need for new and alternative designs that allow a user to apply and distribute a product.

In a first non-limiting example, a cosmetic applicator comprises a main body portion having a first end and a protrusion extending away from the first end, the main body portion including a product delivery passageway extending through the main body portion and the protrusion, and an applicator coupled to the protrusion, the applicator defining a rounded application surface for applying the cosmetic or medicinal product to a surface, the applicator having an opening for dispensing the product, the product delivery passageway in fluid communication with the opening, the applicator formed from a thermal storage material.

Additionally or alternatively, the thermal storage material comprises at least one of metal, ceramic, or stone material configured to store and/or transfer thermal energy.

Additionally or alternatively, the thermal transfer material is magnetic.

Additionally or alternatively, the main body portion forms a surface of the product delivery passageway that contacts the product.

Additionally or alternatively, the protrusion is flexible.

Additionally or alternatively, the housing has flexible walls.

Additionally or alternatively, the protrusion extends at least partially through the opening in the applicator.

Additionally or alternatively, a portion of the applicator extends into the product delivery passageway.

Additionally or alternatively, the applicator is a ball fixed with a non-rotational connection to the protrusion.

Additionally or alternatively, the opening in the applicator ball extends completely through the applicator ball, the opening including a first section receiving the protrusion and a second section in fluid communication with the application surface.

Additionally or alternatively, the first section has a first inner diameter and the second section has a second inner diameter, wherein the first inner diameter is larger than the second inner diameter.

Additionally or alternatively, the first section has a first axial length and the second section has a second axial length, wherein the first axial length is shorter than the second axial length.

Additionally or alternatively, the cosmetic applicator further comprises a housing defining a reservoir for holding a cosmetic or medicinal product, wherein the first end of the main body portion is configured to be coupled to the housing, wherein the housing has flexible walls.

Additionally or alternatively, the main body portion and the housing are integrally formed.

In a further non-limiting example, a dispenser comprises an applicator made of thermal storage material and comprising a rounded application face for applying a product to a surface, and a main body portion having a base attached to the housing and a stem extending away from the base, the stem coupled to the applicator, the main body portion defining a delivery passageway configured to convey the product from the reservoir to the application face, the delivery passageway ending at the applicator, wherein the applicator is fixed with a non-rotational connection to the stem.

Additionally or alternatively, the thermal storage material comprises at least one of metal, ceramic, or stone.

Additionally or alternatively, the applicator is a ball and the stem extends at least partially through an aperture in the applicator ball.

Additionally or alternatively, the stem is flexible.

In another non-limiting example, an applicator tip comprises a main body portion having a base adapted to be coupled to a housing and a stem extending from the base, the main body portion at least partially defining a product delivery passageway extending through the base and stem to convey a product stored in the housing, the main body portion forming a surface of the product delivery passageway that contacts the product, and an applicator ball fixed to the stem, the applicator ball fixed against rotation or axial movement relative to the stem, the applicator ball formed from a thermal storage material, the applicator ball having an application face for applying the product to a surface, the product delivery passageway ending at the applicator ball.

Additionally or alternatively, the thermal storage material comprises at least one of metal, ceramic, or stone material configured to store and/or transfer thermal energy.

Additionally or alternatively, the stem extends at least partially through an opening in the applicator ball.

The above summary of some example embodiments is not intended to describe each disclosed embodiment or every implementation of the present disclosure. The Figures, and Detailed Description, which follow, more particularly exemplify these embodiments.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
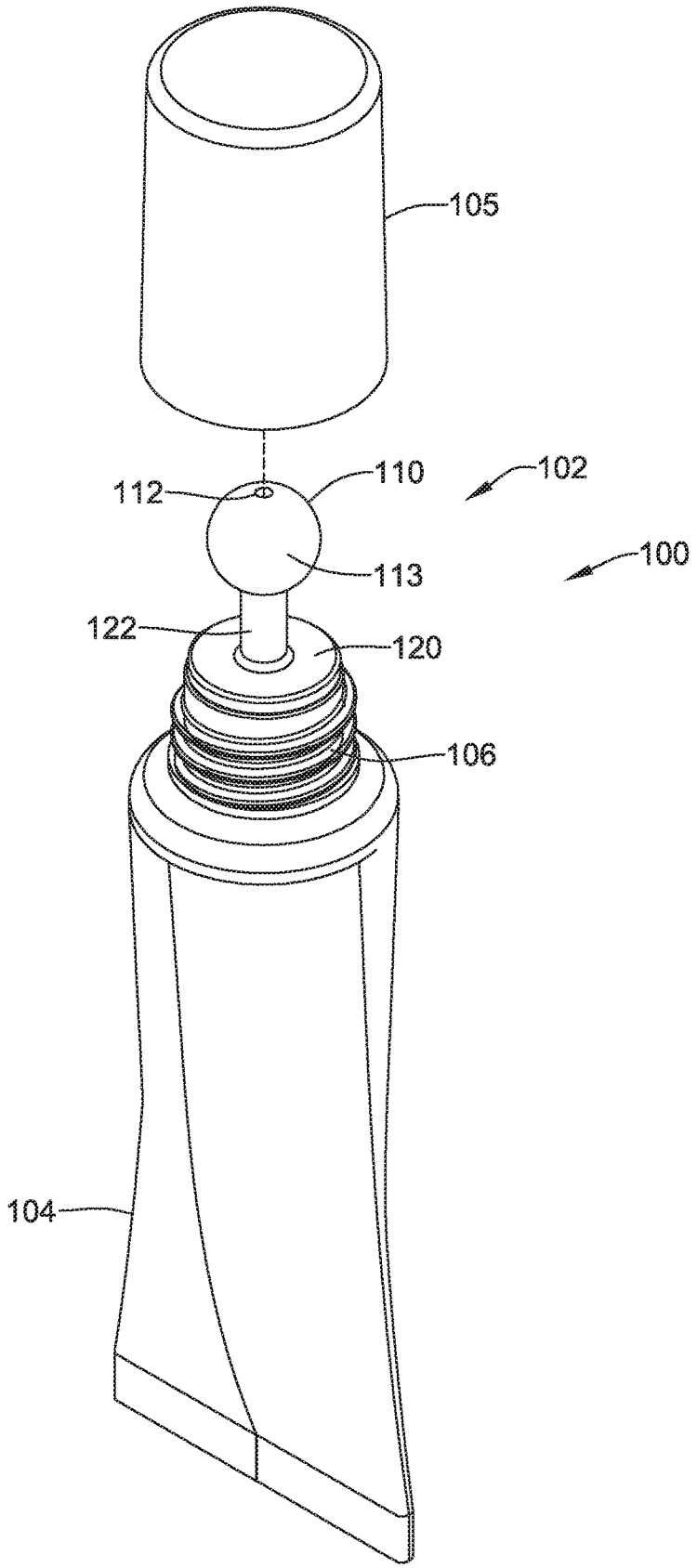
FIG. 1 is a perspective view of an example ball tip applicator with the cap separated.

This disclosure is directed to dispensers with applicator tip assemblies that are able to transfer and/or store and maintain a level of thermal energy. The applicator tip assemblies may include a thermal storage applicator portion having an application face and comprising various metals, ceramics, glass, stone materials, rock, gemstone, imitation gemstone, glass stone, volcanic stone, or composites thereof, whether natural or synthetic, that can be heated or cooled and are able to retain and/or transfer the heated or cooled condition for a period of time. More importantly, in some embodiments, due to the choice of materials and the relative size of the thermal storage applicator portion, the thermal storage applicator portions has the ability to convey a sensation of warming or cooling, and can regenerate that ability without external heating or cooling, other than exposure to ambient conditions. The applicator portion defines an application surface and a bore, through which product may be dispensed. A product may be dispensed from the dispenser through the applicator tip assembly for application to a surface such as, for example, a user's skin. By virtue of the thermal retention or transfer of the thermal storage applicator portion, thermal energy may be applied to the dispensed product so that it may be heated or cooled during application. Moreover, the application face of the thermal storage applicator portion may transfer heat to or from the user's skin, thereby causing the user to feel a thermal sensation (warm or cool depending on the thermal energy in or transferred via the thermal storage applicator portion). In some cases, the heat or cold transfer may also minimize or alleviate pain or discomfort caused by damage to the skin or other surface.

The choice of material for the thermal storage applicator portion will be chosen because of its ability to convey a thermal property to the skin of the user. In most instances, the thermal storage applicator portion will convey a cooling sensation to the skin. Due to its thermal properties, size, and shape, the thermal storage applicator portion will convey this cooling sensation, in theory, by absorbing some heat from the user's skin. As the tip warms, the cooling property can be regenerated simply by removing the tip from the skin. A relatively quick return to ambient temperature will restore the thermal storage applicator portion's cooling capability. Of course, the thermal storage applicator portion will regain some of its cooling ability even before it returns to ambient temperatures. Other important properties of the thermal storage applicator portion include but are not limited to its size (mass and/or volume), surface characteristics, and its porosity.

Suitable thermal storage materials include metals, such as but not limited to aluminum, titanium, steel, nickel, tin, copper, brass, platinum, alloys thereof. In some embodiments, the alloy ZAMAK (or ZAMAC) may be used. In others, stainless steel may be used. In still further embodiments, the metal may be magnetic.

In some embodiments, thermal storage material may be a stone material. While features of various illustrative implementations are described, in other implementations, the thermal storage applicator portion may be configured in any form suitable for the application of the product to be dispensed. For example, the thermal storage applicator portion may be constructed in any suitable size and may have any suitable mass, volume, and/or surface treatment desired for a given application.

As used herein the term "stone" or "stone material" means any stone, rock, mineral, ore, gemstone, imitation gemstone, glass stone, volcanic stone or composites thereof whether naturally occurring or synthetic. For example, river stone is a naturally occurring stone that may be used in some embodiments. Examples of suitable stone materials include, without limitation, imitation gemstone, glass stone, volcanic stone, choral stone, metallic stone or ore, magnetic stone, concrete, composites, or the like. For purposes of this specification, the term "glass stone" is meant to include natural and man-made forms of glass.

Exemplary mineral gemstones include but are not limited to agate, alexandrite, amethyst, ametrine, apatite, aventurine, azurite, beintoite, beryl, bloodstone, carnelian, chrysoberyl, chrysocolla, citrine, diamond, diopside, emerald, falcon's eye, fluorite, garnet, heliotrope, hematite, hiddenite, iolite, jade, white jade, jasper, red jasper, labradorite, lapis lazuli, larimar, malachite, marcasite, moonstone, morganite, obsidian, onyx, opal, peridot, quartz, rock crystal, rose quartz, ruby, sapphire, selenite, sodalite, spinel, sunstone, tanzanite, tiger's eye, topaz, tourmaline, turquoise, yogo sapphire, and zircon. In some embodiments, one or more of diamond, hematite, jade, moonstone, rock crystal, ruby or sapphire may be used. In some embodiments, jade is used, including green jade, white jade, and/or colored jade In other embodiments, rock crystal may be used. Regardless of the choice of gemstone, any color or quality may be used.

Organic gemstones include but are not limited to abalone, amber, ammolite, copal, coral, ivory, jet, pearl, and nacre. In some embodiments, pearl may be used. Synthetic gemstones include but are not limited to, cubic zirconia, moissanite, synthetic diamond, synthetic ruby, synthetic sapphire, synthetic emerald, and composite gemstones. Stone, other than gemstones listed above, includes but is not limited to stone or rock such as soapstone, granite, marble, river rock, river stones, pebbles, metallic stone/ores (germanium for example), volcanic stone, engineered/composite stone, or synthetic stone.

Engineered, composite or synthetic stone can be made from one or more stones or stone powders which are bound together. As an example, concrete is made with aggregate stone material and binders. Concrete can be formed into many shapes via molding, cutting, grinding, etc. and even polished. Other engineered, composite, and synthetic stone is readily available, or can be custom made with stone materials of choice.

The thermal storage applicator portion may be formed of any combination of materials to achieve the desired results, and may be formed by any number of methods. For example, a spherical or ball shaped metal thermal storage applicator portion may be formed starting with a ball bearing that is then machined to create a through hole and any internal ridges or recesses needed for mounting. Alternatively, a spherical, ball shaped, or partially rounded metal thermal storage applicator portion may be cast using conventional metal casting techniques, with the internal parts being excluded via the casting method. Internal ridges or recesses may be cast or created post-casting by machining. In some examples, the outer opening may be deburred, chamfered or beveled to avoid sharp edges and provide a continuously smooth outer surface. Further, the thermal storage applicator portion may be subject to one or more finishing steps. For examples, it may be subjected to one or more secondary or finishing operations, such as buffing, polishing, chroming or electroplating, for example.

The applicator tip assembly may be coupled to a housing such as a tube, bottle, tottle or other container for storing product. The main body of the applicator tip assembly may be integrally formed with the housing, or made separately and coupled to the housing such as by injection molding, snap fit, friction fit, threaded connection, or adhesive. In some embodiments, the applicator tip assembly may be made separate of the housing and coupled thereto in a later operation.

Cosmetics applicators may fall into two broad categories, flow-through applicators and non-flow-through applicators. Flow-through applicators are useful with tubes, bottles, airless pumps, click pens, and other types of packaging, and generally include an applicator in fluid communication with a reservoir containing product. The product flows from the reservoir to the applicator. These types of applicators are well-suited for eye gel and cream, lip gloss, liquid foundation, acne treatment, and the like. Non-flow-through applicators are useful as stand-alone applicators to be used with a separate reservoir of product. The non-flow-through applicators may or may not have a handle and may be in a bottle/wand configuration, and the like. These types of applicators are well-suited for mascara, wand-type lip gloss, eyeshadow, and the like.

FIG. 1 shows an example dispenser 100 with an applicator tip assembly 102 and a housing 104. In this example, the applicator tip assembly 102 is attached to the housing 104 such that product may be conveyed from the housing 104 through the applicator tip assembly 102. In other examples, the applicator tip assembly 102 may include a dropper-type applicator configured to screw onto the housing.

In the example shown in FIG. 1, the applicator tip assembly 102 includes an applicator 110 that is spherical or ball shaped. In other examples, the applicator 110 may have other shapes such as a partial sphere, dumbbell, oblong, stadium, teardrop, egg, etc. The applicator 110 may generally have a rounded end defining an application surface 113. The applicator ball 110 is made of a material capable of holding and retaining a thermal charge. In this sense, the applicator portion is sometimes referred to herein as a "thermal storage applicator ball" 110.

In one example, the applicator ball 110 can be made of a metal (e.g., zinc, aluminum, magnesium, titanium, stainless steel, nickel, tin, copper, brass, platinum, alloys thereof, including ZAMAK, etc.) which may be molded or die-cast as a ball. Secondary manufacturing process steps, such as electroplating, may be performed in order to prevent corrosion of the metal with molded or die-casted parts, and/or to provide the applicator ball 110 with a smooth, and in some cases, mirror finish.

However, in other examples, any suitable material may be used that is capable of transferring or retaining heat or cold during the application of the product. Examples of other suitable materials include, without limitation, ceramic, glass, stone materials, rock materials, gemstone, imitation gemstone, glass stone, volcanic stone, choral stone, metallic stone or ore, magnetic stone, concrete, or composites thereof. For purposes of this specification, the term "glass stone" is meant to include natural and man-made forms of glass. Suitable gem stones include, but are not limited to, agate, amethyst, aquamarine, diamond, emerald, garnet, jade, obsidian, onyx, opal, pearl, quartz, ruby, sapphire, topaz, and turquoise. While certain applicator portions are described herein as being capable of transferring or retaining heat or cold during the application of the product, in other embodiments, applicator portions according to this disclosure need not necessarily be capable of transferring or retaining heat or cold during the application of the product. For instance, thermal storage applicator portions according to embodiments of this disclosure may completely or partially comprise a porous or aerated stone or aggregate material (e.g., pumice or other volcanic stone, aerated concrete, etc.).

According to certain embodiments, metal, stone, or a plurality of metal and/or stone materials, may be ground or crushed into a powder or an aggregate and then formed into a ball shape via, for example, injection molding or compression. The term "powder" is used herein with reference to relatively small particles, as opposed to "aggregate" which refers to relatively large particles. For our purposes here, both refer to smaller particles. According to certain embodiments, the powder may include granules having an average diameter of about 10 nm to about 10 micron. According to certain embodiments, an aggregate may include particles having an average diameter of at most about 10 millimeters. In some embodiments, the powder or aggregate may include granules having an average diameter from about 10 nm to about 150 microns; about 10 microns to about 10 millimeters, about 10 microns to about 100 microns; 100 microns to about 500 microns; 500 microns to about 1 millimeter; about 1 millimeter to about 5 millimeters; and/or about 5 millimeter to about 10 millimeters. In some embodiments, the powder or aggregates may include granules having an average diameter of about 10 nm, about 25 nm, about 50 nm, about 100 nm, about 150 nm, about 250 nm, about 500 nm, about 750 nm, about 1 micron, about 10 microns, about 25 microns, about 50 microns, about 100 microns, about 250 microns, about 500 microns, about 1 millimeter, about 2.5 millimeters, about 5 millimeters, and about 10 millimeters or any range of values between any two of these. However, in still other embodiments, the powder or aggregate may include granules larger or smaller than those listed. The granules may be of substantially uniform size (e.g., average diameter of about 25 microns, about 50 microns, about 250 microns, 2.5 millimeters, etc.) or size range (e.g., from about 25 microns to about 50 microns; 100 microns to about 250 microns, etc.), or the granules may include a variety of different sizes or size ranges. Moreover, the granules may be substantially uniform in shape (e.g., spherical, cubic, etc.) or may be non-uniform (e.g., randomly shaped crushed particles). Resins or other binders can be mixed with the ground metal and/or stone to aid in the binding. Moreover, once the ground metal and/or stone and resin/binder mixture has been molded, the resins or other binders may be removed via, for example, heat melting the resin or binder. According to certain embodiments, the metal and/or stone can be coated or sealed with, for example, a polyurethane sealant, a lacquer, an ultraviolet (UV) inhibitor spray, a filler, or the like. According to still other embodiments, the metal and/or stone can be polished (or roughed) to a desired surface finish.

In some implementations, the applicator ball 110 may comprise ceramics, high-density plastics, composites, or the like. Additionally, the applicator ball 110 may include one or more additional materials such as, for example, metal, plastic, glass, wood, carbon fiber, or the like. For instance, in some embodiments, metal, plastic, glass, wood, carbon fiber, or other material may be embedded in, on, or around an applicator ball 110 made initially from stone, thus making it a composite applicator ball 110. In one specific example, an applicator ball 110 may include a stone with a metal ring around at least a portion of an outer perimeter of the stone.

Referring back to FIG. 1, the applicator tip assembly 102 may further include a main body portion 120 configured to couple the applicator ball 110 to the housing 104 in a spaced-apart relationship. The applicator ball 110 may further include or define an opening 112 extending completely through the applicator ball 110. The opening 112 is in fluid communication with the housing 104 to convey the cosmetic or medicinal product from the housing 104 to exit the applicator tip assembly 102 at the application surface 113 of the applicator ball 110. In some examples, the opening 112 may have a diameter between 0.8 mm to 3.0 mm.

FIG. 1 shows the main body portion 120 as having a neck portion, shown as a generally cylindrical protrusion 122, extending longitudinally from the main body portion 120 and connecting to the applicator ball 110. The protrusion 122 may have a diameter of between 3 mm and 8 mm, and the applicator ball 110 may have a diameter of between 4 mm and 20 mm.

In some examples, the main body portion 120 may be made of a thermoplastic polymer, such as, for example, polypropylene, which is non-reactive with the product stored in the housing 104. In other implementations, the main body portion 120 may be made of plastic, metal, glass, or any other suitable material. The protrusion 122 may be rigid, allowing no movement of the applicator ball 110 relative to the housing 104. A rigid protrusion 122 may be made of materials such as, but not limited to, acrylonitrile butadiene styrene (ABS), polypropylene (PP), polyethylene (PE), or polyethylene terephthalate (PET).

In other examples, the protrusion 122 may be flexible, allowing the applicator ball 110 to be moved in an arc relative to the housing 104. A flexible protrusion 122 may be made of an elastomeric, flexible, or deformable material, such as, but not limited to, rubber, a thermoplastic elastomer (TPE), silicone, or nitrile rubber (NBR).

In some embodiments, the protrusion 122 may be made of a flexible material, allowing it to be bent when a user pushes against the applicator ball 110, but returning to a substantially straight position aligned with the longitudinal axis of the housing 104 when the pushing force is removed. In other embodiments, the protrusion 122 may be made of a material allowing for the applicator ball 110 to be placed in any angle relative to the longitudinal axis of the housing 104, and to retain that position until the user moves the applicator ball 110 again. In this manner, the user may push against the applicator ball 110 to bend the protrusion 122, moving the applicator ball 110 to a desired position during use. The protrusion 122 will remain in the bent position until the user moves it back into a position substantially aligned with the longitudinal axis, in order to replace the cap 105.

The dispenser 100 may also include a cap 105 that encapsulates the applicator tip assembly 102 when the dispenser 100 is not in use. The cap 105 is configured to be coupled to the housing 104, such as by use of a snap-fit attachment, a threaded attachment, a press or friction fit, one or more hinges, or any other suitable means of attachment. In the example shown in FIG. 1, the cap 105 is coupled to the housing 104 by a threaded attachment. The housing 104 includes external threading 106 that mates with internal threading 108 (shown in FIG. 2) on the cap 105.

Figure 2:
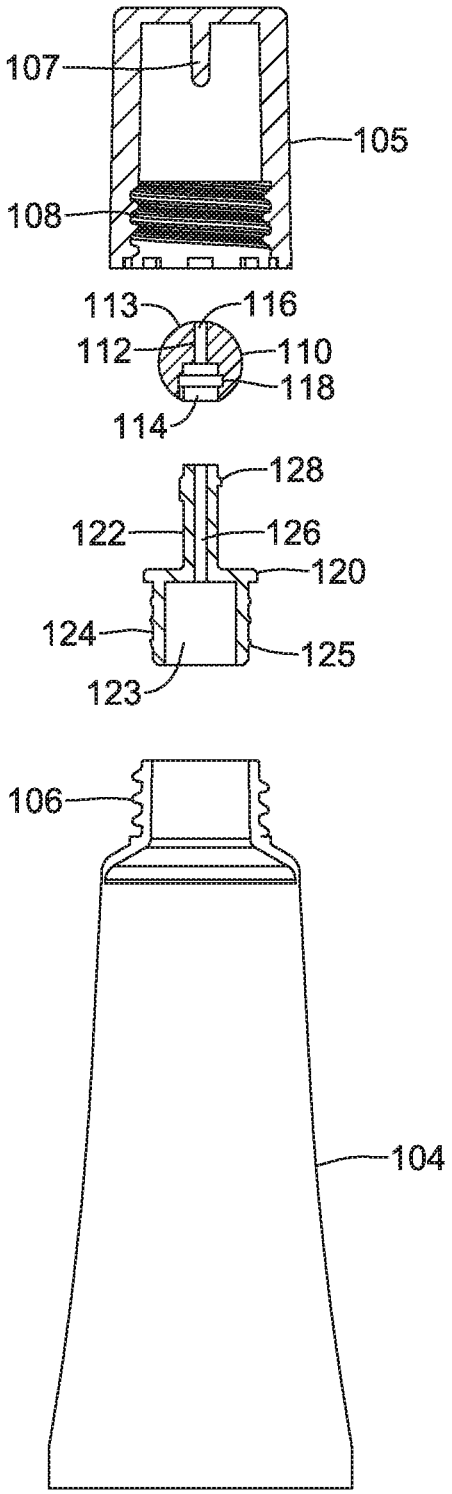
FIG. 2 is an exploded cross-sectional view of the ball tip applicator of FIG. 1.

FIG. 2 shows an exploded cross-sectional view of the housing 104, main body portion 120, applicator ball 110, and cap 105. The housing 104 may define a reservoir for receiving the product, as shown in FIG. 2. In other examples, the housing 104 may include a separate inner reservoir for holding the product. The cap 105 may include a plug 107 extending downwardly from the inner surface of the cap 105 that seals the opening 112 in the applicator ball 110 when the cap 105 is connected to the housing 104. The plug 107 may be shaped to match the opening 112. For example, both the plug 107 and the opening 112 may be cylindrical. In some examples, the plug 107 may be a thermoplastic polymer or any other material which is non-reactive or resistant to the product being dispensed, such as various metals, plastics, ceramics, composites, or the like. Additionally or alternatively, the plug 107 may be elastomeric or deformable, such that when the cap 105 is in place, the plug 107 may expand and deform somewhat to seal the opening 112. The cap 105 may thus prevent leakage of product when the cap 105 is in place over the housing 104 and the dispenser 100 is turned upside down or placed horizontally. The cap 105 may include internal threading 108 to mate with the external threading 106 on the housing 104.

In some embodiments, main body portion 120 includes a base 124 at a first end configured to be coupled to the housing 104. The base 124 may be coupled to the housing 104 by a threaded connection, a friction fit, a snap fit, overmolding, or co-molding. In some embodiments, the base 124 and the housing 104 may be formed as a single monolithic element, particularly in the case of a tube housing. In the example shown in FIG. 2, the base 124 may have one or more external ridges 125 that engage an internal surface of the housing 104.

The main body portion 120 may include a protrusion 122 extending away from the base 124 and configured to be coupled to the thermal storage applicator ball 110. The main body portion 120 may define a product delivery passageway 126 that contacts the product, the product delivery passageway 126 extending from a cavity 123 in the base 124 and through the protrusion 122. In some embodiments, a portion of the applicator 110 may extend into the product delivery passageway 126 (not shown). In these embodiments, the applicator 110 may include an extension opposite the opening 112 that is received within the protrusion 122. In other embodiments, a portion of the protrusion 122 may extend into the applicator 110. In some embodiments, the opening 112 in the thermal storage applicator ball 110 may include a first section 114 and a second section 116. The first section 114 may be sized to receive the protrusion 122 and the second section 116 is in fluid communication with the application surface 113. The first section 114 has a first diameter and the second section 116 has a second diameter, where the first diameter may be larger than the second diameter, as shown in FIG. 2. In some examples, the first section 114 may have a first axial length that is shorter than a second axial length of the second section 116. In other examples, the first and second axial lengths may be the same, or the first axial length may be longer than the second axial length. The protrusion 122 may be coupled to the base 124 by a threaded connection, a friction fit, a snap fit, overmolding, or co-molding. In some embodiments, and as shown in FIG. 2, the protrusion 122 and base 124 may be formed as a single monolithic element. In other embodiments, the protrusion 122, base 124, and housing 104 may be formed as a single monolithic element.

The applicator ball 110, protrusion 122, and base 124 may be formed separately and then connected during assembly, with the applicator ball 110 fixed against rotation or axial movement relative to the protrusion 122. The applicator ball 110, the protrusion 122, and base 124 may be made of the same or different materials. In some examples, the applicator ball 110 and the protrusion 122 may be made as a single, monolithic piece that is then attached to the base 124. The monolithic piece forming the applicator ball 110 and protrusion 122 may be made of metal, stone, ceramic, or composites thereof. In further examples, the single monolithic piece may include the base 124, the protrusion 122, and the applicator ball 110. The monolithic piece including the applicator ball 110 and protrusion 122, and in some cases the base 124, may define the product delivery passageway 126 between the housing 104 and the application surface 113 such that the product contacts the monolithic piece as it travels between the housing 104 and the application surface 113. In other examples, an internal polymer sleeve (not shown) may be disposed within the product delivery passageway 126 in a monolithic piece that defines the applicator ball 110, protrusion 122, and in some cases the base 124, to define the product contacting surface.

Figure 3A:
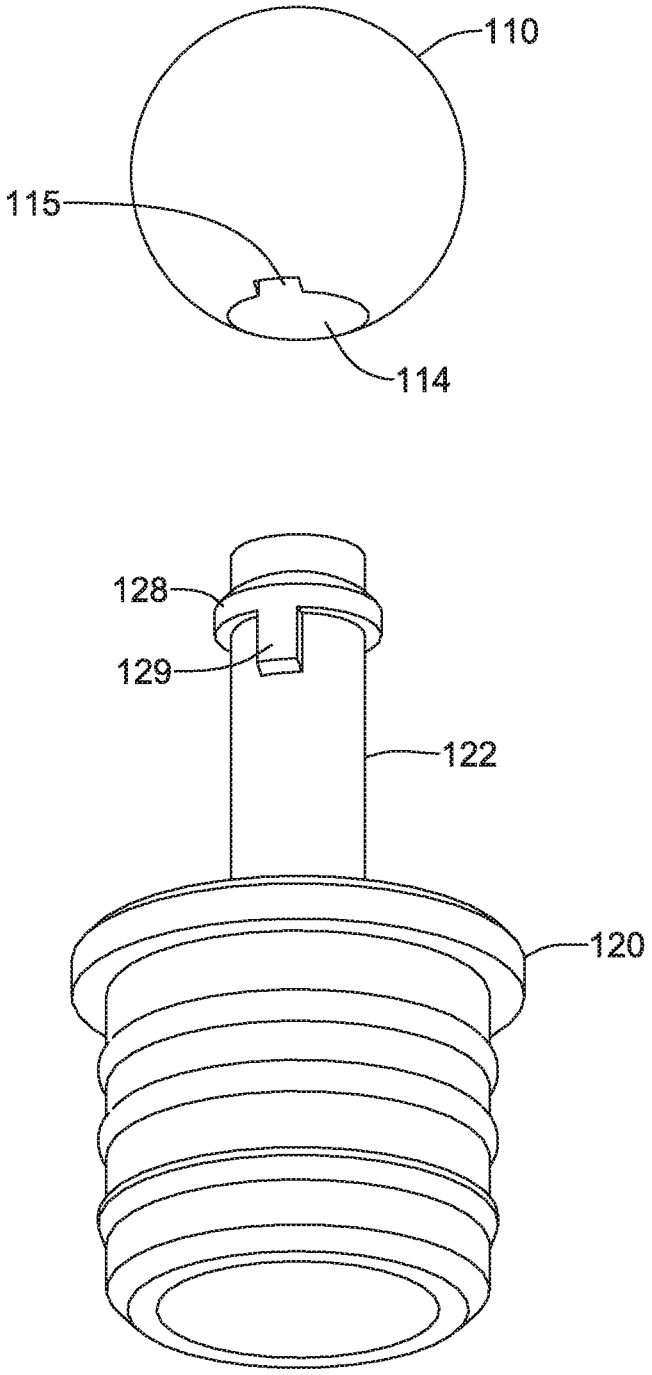
FIG. 3A is an exploded perspective view of the tip assembly of FIG. 1.

The thermal storage applicator ball 110 may be connected to the protrusion 122 by a friction fit, a snap fit, weld, adhesive, or other coupling that results in the thermal storage applicator ball 110 being fixed against rotation or axial movement with respect to the protrusion 122. For example, the protrusion 122 may include at least one ridge 128 that mates with at least one recess 118 in the first section 114 of the thermal storage applicator ball 110. As seen in the enlarged views in FIGS. 3A and 3B, the protrusion 122 of the main body portion 120 may include a circumferential ridge 128 and a tab 129 projecting axially therefrom. The tab 129 engages a cutout 115 in the first section 114 of the opening in the thermal storage applicator ball 110 and prevents rotation thereof relative to the protrusion 122. The engagement of the circumferential ridge 128 within the recess 118 prevents axial movement of the thermal storage applicator ball 110 relative to the protrusion 122.

Figure 3B:
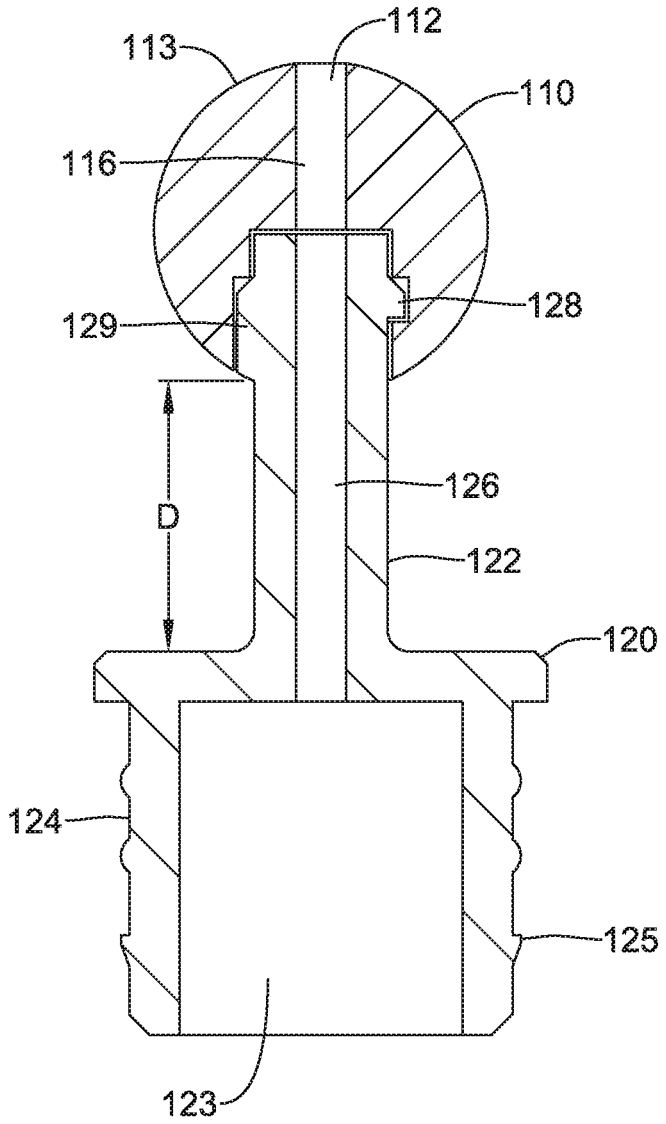
FIG. 3B is a cross-sectional view of the tip assembly of FIG. 1.

As seen in FIG. 3B, when the thermal storage applicator ball 110 is attached to the protrusion 122 of the main body portion 120, the second section 116 of the opening 112 is in fluid communication with the product delivery passageway 126 in the protrusion 122, forming a dispensing path for the product from the housing 104, through the cavity 123 and product delivery passageway 126 in the main body portion 120, and through the opening 112 in the thermal storage applicator ball 110 to the application surface 113. Both the second section 116 of the opening 112 and the product delivery passageway 126 may have the same diameter, providing a constant diameter pathway for product to flow through the applicator tip assembly 102. In some examples, the second section 116 and product delivery passageway 126 may both have a diameter between 0.8 mm to 3.0 mm. The opening 112 at the application surface 113 may be chamfered or beveled to provide a rounded, smooth edge at the application surface 113.

The protrusion 122 may space the thermal storage applicator ball 110 a distance D away from the base 124. In some examples the distance D may be between 1 mm and 80 mm. In other examples, the protrusion 122 has a length such that the entire protrusion 122 extends within the applicator ball 110, with the bottom of the applicator ball 110 in contact with the base 124 (not shown). In the example shown in FIG. 3B, the protrusion 122 extends only partially through the applicator ball 110, such that the second section 116 of the opening 112 through the applicator ball 110 defines a portion of the product delivery passageway above the protrusion 122. In other examples, the protrusion 122 may extend completely through the applicator ball 110, such that it is substantially flush with the application surface 113 (not shown). In such an example, the protrusion 122 forms the entirety of the product delivery passageway 126, with the product not contacting the applicator ball 110 until the product is dispensed onto the application surface 113.

Figure 4:
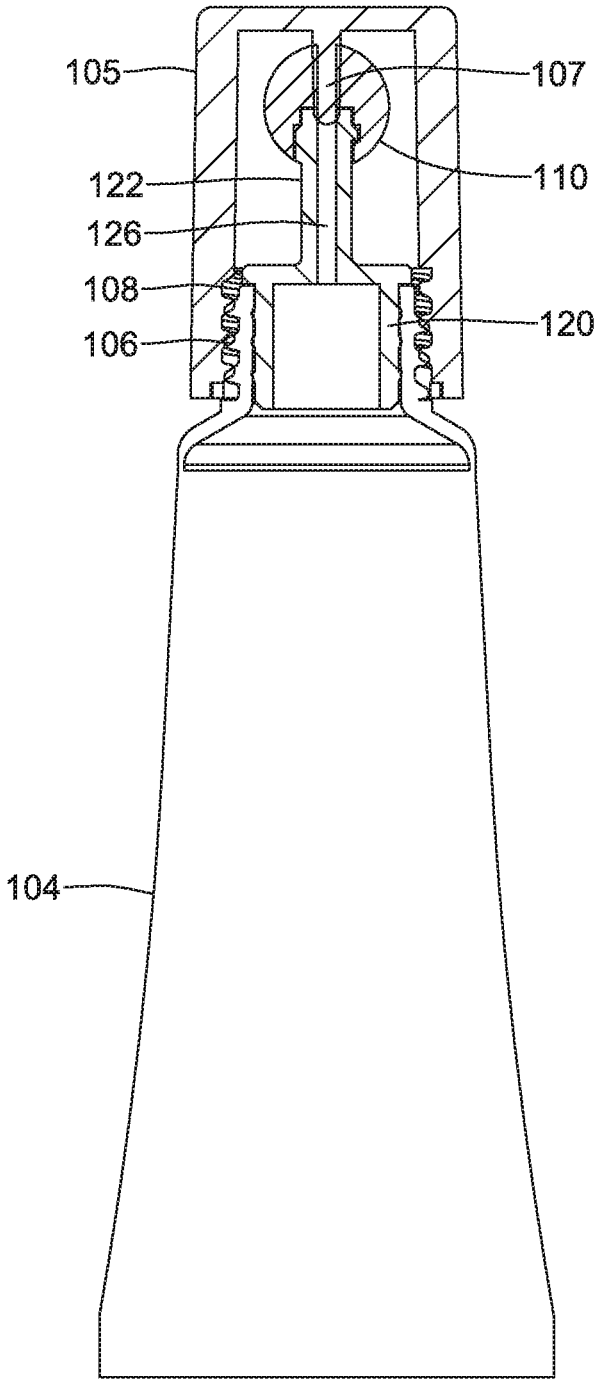
FIG. 4 is a cross-sectional view of the ball tip applicator of FIG. 1 with the cap in place.

FIG. 4 shows the dispenser 100 with the cap 105 attached to the housing 104 via engagement of the internal threading 108 on the cap 105 with the external threading 106 on the housing. The plug 107 on the cap 105 is disposed within the opening 112, preventing product from leaking when the dispenser 100 is turned upside down or placed on its side. The plug 107 may be particularly important for liquid products.

In some embodiments, the dispenser 100 is a flow-through style applicator device, which incorporates a thermal storage applicator ball 110 disposed on a housing 104. The applicator ball 110 may define both a product dispensing element, via opening 112, and an application surface 113. The ball shaped applicator ball 110 provides the advantage of allowing the user to dispense a controlled amount of product via the opening 112 and to then distribute, smooth, and/or blend the product over the skin with the spherical application surface 113, using a single device. This eliminates the need for a separate implement to achieve the desired distribution of the product. The thermal storage properties of the applicator ball 110 may provide a cooling sensation to the user's skin as the product is applied and the smooth application surface 113 is moved across the skin. In examples where the product is to be used on a delicate area of the body, such as with an under-eye serum, the provision of a cooling sensation may be desired.

In some embodiments, the walls of the housing 104 may be substantially rigid, and the user dispenses the product by inverting the dispenser 100 and allowing gravity to aid in dispensing the product from the opening 112. In other embodiments, the walls of the housing 104 may be flexible, allowing the user to squeeze the housing 104 to dispense the product when the dispenser 100 is in an upright or angled orientation. A squeezable housing 104 may provide the advantage of allowing the user to control the amount of product delivered based on the amount of pressure applied to the housing 104. The housing 104 is shown in the figures as a squeezable tube, although the container need not be so limited. In some embodiments, the housing 104 may be a tottle, bottle, or other conventional cosmetics container. In some embodiments, the applicator tip assembly 102 may be removable from the housing 104, allowing the reservoir in the housing 104 to be refilled. In other embodiments, it may be permanently affixed (that is, not intended to be removed by the user).

In addition to the squeeze mechanism for dispensing the product, the following is a discussion of additional examples, without limitation, of delivery mechanisms for dispensing a product from the housing. The first example may be implemented using a click or a reverse click operation, whereby the user may operate the dispenser by moving the applicator tip relative to the housing in either a clockwise or counterclockwise direction.

In yet another example, a delivery mechanism for dispensing the product may be by a pressurized dispenser, such as an aerosol dispenser. In certain embodiments wherein the delivery mechanism is an aerosol delivery mechanism, the composition will be held under pressure in a container and will be dispersed along with an aerosol propellant in response to actuation by a user. Actuation may be by depressing, rotating, tilting, or otherwise manipulating the applicator tip, pressing a button, and/or by any other suitable dispensing mechanism. Details of the construction and propellant of an aerosol dispenser are within the skill of one of ordinary skill in the art and will, therefore, not be described in detail herein.

In yet another example, a delivery mechanism for dispensing product may be an airless pump. The term airless pump refers to a pump that provides dispensing of a substance from a container under pressure in essentially a single direction without permitting reverse (intake) flow of air via the pump. That is, as product is pumped from the container, the pumped product is not replaced with a corresponding volume of air through the pump. In addition to preventing reverse intake flow of air, an airless pump typically does not allow intake of any other substances to replace the volume of product pumped out of the container. For example, an airless pump could include a one-way valve, such as a check valve.

In FIGS. 1-4, the thermal storage applicator ball 110 is shown as being a generally spherical element. In some examples, the thermal storage applicator ball 110 is made at least in part of metal, and in the case of stainless steel, for instance, may have a mass from about 0.8 to about 3 grams. According to certain other embodiments, thermal storage applicator portions made of stone according to this disclosure may have a mass of stone of at least about 0.1 grams. According to certain other embodiments, thermal storage applicator portions according to this disclosure may have a mass of at most about 10 grams regardless of the material. In some embodiments, thermal storage applicator portions may have a mass of about 0.1 grams to about 10 grams, from about 0.1 grams to about 0.5 grams; about 0.5 grams to about 1 gram; about 1 gram to about 5 grams and/or about 5 grams to about 10 grams. In some embodiments, the thermal storage applicator portion has a mass of about 0.1 grams, about 0.5 grams, about 1.0 grams, about 3 grams, about 4 grams, about 5 grams, about 10 grams, and any range between any two of these values. However, according to still other embodiments, thermal storage applicator portions according to this disclosure may have masses smaller or larger than those listed above.

While features of various illustrative implementations are described, in other implementations, the applicator tip assembly may be configured in any form suitable for the application of the product contained in dispenser 100. For example, the applicator tip assembly may be constructed in any other suitable shape and size and may have any suitable mass, volume, and/or surface treatment desired for a given application.

This disclosure is not limited to the particular systems, devices and methods described, as these may vary. The terminology used in the description is for the purpose of describing the particular versions or embodiments only, and is not intended to limit the scope.

As used in this document, the singular forms "a," "an," and "the" include plural references unless the context clearly dictates otherwise. Unless defined otherwise, all technical and scientific terms used herein have the same meanings as commonly understood by one of ordinary skill in the art. Nothing in this disclosure is to be construed as an admission that the embodiments described in this disclosure are not entitled to antedate such disclosure by virtue of prior invention.

As used in this document, "comprising" means "including, but not limited to." Also as used in this document, "optional" or "optionally" means that the subsequently described event or circumstance may or may not occur, and that the description includes instances where the event occurs and instances where it does not. With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, et cetera. As a non-limiting example, each range discussed herein can be readily broken down into a lower third, middle third and upper third, et cetera. As will also be understood by one skilled in the art all language such as "up to," "at least," and the like include the number recited and refer to ranges which can be subsequently broken down into subranges as discussed above. Finally, as will be understood by one skilled in the art, a range includes each individual member.

Various of the above-disclosed and other features and functions, or alternatives thereof, may be combined into many other different systems or applications. Various presently unforeseen or unanticipated alternatives, modifications, variations or improvements therein may be subsequently made by those skilled in the art, each of which is also intended to be encompassed by the disclosed embodiments.

Although the present invention has been described in considerable detail with reference to certain preferred embodiments thereof, other versions are possible. Therefore, the spirit and scope of the appended claims should not be limited to the description and the preferred versions contained within this specification.

What is claimed is:

1. A cosmetic applicator comprising:

a main body portion having a first end and a protrusion extending away from the first end, the main body portion including a product delivery passageway extending through the main body portion and the protrusion; and an applicator coupled to the protrusion, the applicator defining a rounded application surface for applying the cosmetic or medicinal product to a surface, the applicator having an opening for dispensing the product, the product delivery passageway in fluid communication with the opening, the applicator formed from a thermal storage material, wherein the applicator is a ball fixed with a non-rotational connection to the protrusion, wherein the opening in the applicator ball extends completely through the applicator ball, the opening including a first section receiving the protrusion and a second section in fluid communication with the application surface.

2. The cosmetic applicator of claim 1, wherein the thermal storage material comprises at least one of metal, ceramic, or stone material configured to store and/or transfer thermal energy.

3. The cosmetic applicator of claim 2, wherein the thermal transfer material is magnetic.

4. The cosmetic applicator of claim 1, wherein the main body portion forms a surface of the product delivery passageway that contacts the product.

5. The cosmetic applicator of claim 1, wherein the protrusion is flexible.

6. The cosmetic applicator of claim 1, wherein the protrusion extends at least partially through the opening in the applicator.

7. The cosmetic applicator of claim 1, wherein the first section has a first inner diameter and the second section has a second inner diameter, wherein the first inner diameter is larger than the second inner diameter.

8. The cosmetic applicator of claim 7, wherein the first section has a first axial length and the second section has a second axial length, wherein the first axial length is shorter than the second axial length.

9. The cosmetic applicator of claim 1, further comprising a housing defining a reservoir for holding a cosmetic or medicinal product, wherein the first end of the main body portion is configured to be coupled to the housing, wherein the housing has flexible walls.

10. An applicator tip comprising:

a main body portion having a base adapted to be coupled to a housing and a stem extending from the base, the main body portion at least partially defining a product delivery passageway extending through the base and stem to convey a product stored in the housing, the main body portion forming a surface of the product delivery passageway that contacts the product; and an applicator ball fixed to the stem, the applicator ball fixed against rotation or axial movement relative to the stem, the applicator ball formed from a thermal storage material, the applicator ball having an application face for applying the product to a surface, the product delivery passageway ending at the applicator ball.

11. The applicator tip of claim 10, wherein the thermal storage material comprises at least one of metal, ceramic, or stone material configured to store and/or transfer thermal energy.

12. The applicator tip of claim 10, wherein the stem extends at least partially through an opening in the applicator ball.

* * * * *